US008436247B2

(12) United States Patent
Mase

(10) Patent No.: US 8,436,247 B2
(45) Date of Patent: May 7, 2013

(54) TERMINAL COVER

(75) Inventor: Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 149 days.

(21) Appl. No.: 13/157,380

(22) Filed: Jun. 10, 2011

(65) Prior Publication Data

US 2011/0315431 A1 Dec. 29, 2011

(30) Foreign Application Priority Data

Jun. 23, 2010 (JP) ..... 2010-142500

(51) Int. Cl.
*H01R 4/70* (2006.01)

(52) U.S. Cl.
USPC ..... 174/138 F; 174/138 R; 174/135; 174/5 R; 52/101; 439/521; 248/74.4

(58) Field of Classification Search ..... 174/138 F, 174/138 R, 135, 5 R, 5 SB, 139; 439/521, 439/523; 52/101; 248/74.4
See application file for complete search history.

(56) References Cited

U.S. PATENT DOCUMENTS 7,189,922 B1 * 3/2007 Rose et al. ..... 174/66
7,525,048 B2 * 4/2009 Tufari ..... 174/138 F
7,838,775 B2 * 11/2010 Montena ..... 174/138 F
7,884,285 B2 * 2/2011 Spencer ..... 174/138 F

FOREIGN PATENT DOCUMENTS

EP 2105997 A2 9/2009
JP 2008-288056 11/2008

* cited by examiner

*Primary Examiner* — Dhirubhai R Patel
(74) *Attorney, Agent, or Firm* — Gerald E. Hespos; Michael J. Porco; Matthew T. Hespos

(57) ABSTRACT

A terminal cover (A) includes an escaping portion (20) formed by cutting off a part of a peripheral wall portion forming a first accommodating portion (11) to allow an internal space of the first accommodating portion (11) to communicate with a second accommodating portion (12), thereby avoiding interference with a linking portion (53) of a terminal fitting (B). The terminal cover (A) also includes a multi-functional portion (26) which can be assembled with the first accommodating portion (11) and is arranged to close at least a part of the escaping portion (20) and capable of pressing the terminal fitting (B) to prevent a displacement of the terminal fitting (B) in an assembled state.

14 Claims, 17 Drawing Sheets

TERMINAL COVER

BACKGROUND OF THE INVENTION

1. Field of the Invention

The invention relates to a terminal cover.

2. Description of the Related Art

Japanese Unexamined Patent Publication No. 2008-288056 discloses a terminal cover for surrounding a terminal fitting. The terminal fitting has a wire connecting portion to be connected to a wire, a post connecting portion to be connected to a post of a device and a link linking the wire connecting portion and the post connecting portion. The terminal cover has first and second accommodating portions and first and second lids. The first accommodating portion can accommodate the wire connecting portion and includes a first opening for receiving the wire connecting portion. The first lid is mounted to the first accommodating portion to cover the first opening. The second accommodating portion can accommodating the post connecting portion and includes a second opening for receiving the post connecting portion. The second lid can be mounted to the second accommodating portion to cover the second opening.

The terminal cover and terminal fitting are used by initially accommodating the wire connecting portion and the post connecting portion respectively into the first and second accommodating portions. The first lid then is closed over the first opening to surround the wire connecting portion. The post connecting portion then is attached to the post of the device and, finally, the second lid closes the second opening.

Part of a peripheral wall of the first accommodating portion is cut off to form an escaping portion so that internal spaces of the first and second accommodating portions communicate with one another. Thus, the link will not interfere with the peripheral wall of the first accommodating portion when the wire connecting portion and the post connecting portion are accommodated in the first and second accommodating portions.

The first lid closes the first opening in the process of attaching the post connecting portion to the post. However, the internal space of the first accommodating portion is exposed to the outside at the escaping portion. Thus, external matter may enter the first accommodating portion through the escaping portion in the process of attaching the post connecting portion to the post.

The invention was developed in view of the above situation and an object thereof is to prevent external matter from entering a space for a terminal fitting.

SUMMARY OF THE INVENTION

The invention relates to a terminal cover for surrounding a terminal fitting. The terminal fitting has a wire connecting portion to be connected to a wire, a post connecting portion to be connected to a post of a device and a link linking the wire connecting portion and the post connecting portion. The terminal cover has first and second accommodating portions and first and second lids. The first accommodating portion can accommodate the wire connecting portion and includes a first opening receive the wire connecting portion. The first lid is mountable to the first accommodating portion for covering the first opening. The second accommodating portion can accommodate the post connecting portion and includes a second opening used to receive the post connecting portion. The second lid is mountable to the second accommodating portion for covering the second opening. An escaping portion formed by cutting off or recessing a part of a peripheral wall of the first accommodating portion so that an internal space of the first accommodating portion communicates with the second accommodating portion, thereby avoiding interference with the link. A multi-functional portion can be assembled with the first accommodating portion to close at least a part of an opening area of the escaping portion and to press the terminal fitting and prevent displacement of the terminal fitting in an assembled state.

The wire connecting portion is accommodated in the first accommodating portion, the post connecting portion is accommodated in the second accommodating portion and the first lid closes the first opening when the post connecting portion is being attached to the post. Additionally, the multi-functional portion is assembled with the first accommodating portion to close at least a part of the escaping portion and to prevent entry of external matter into the first accommodating portion. The multi-functional portion also prevents displacement of the terminal fitting relative to the terminal cover while attaching the terminal fitting to the post, thereby improving assembly efficiency.

The multi-functional portion preferably integral or unitary with the first lid. Thus, the number of parts can be reduced and the first lid and the multi-functional portion can be assembled with the first accommodating portion by one operation as compared with the case where the multi-functional portion is separate from the first lid.

The first accommodating portion and the first lid preferably are formed with one or more locks that engage to lock the first lid in an assembled state where the first lid closes the first opening. The multi-functional portion preferably is formed with a guide that slides in contact with the opening edge of the escaping portion to guide a displacement of the first lid along a proper assembling path with the first accommodating portion.

When the first lid is assembled with the first accommodating portion, the guiding portion of the multi-functional portion slides in contact with the opening edge of the escaping portion to guide the displacement of the link along the proper assembling path. Thus, the lock of the first lid and that of the main portion are reliably engaged.

The multi-functional portion preferably includes a receiving surface arranged to extend substantially along the wire connected to the wire connecting portion when the multi-functional portion is assembled with the first accommodating portion. Thus, the wire contacts the receiving surface to prevent a buckling deformation of the wire even if an external force acts to move the wire toward the escaping portion.

The multi-functional portion is formed with at least one cutout for accommodating at least one rib formed on the link and projecting toward the multi-functional portion. The engagement of the rib of the link in the cutout of the multi-functional portion prevents displacement of the link relative to the multi-functional portion in a direction crossing a direction in which the link is pressed.

The multi-functional portion includes substantially plate-like portions spaced apart from each other in a penetrating direction of the link through the escaping portion. The plate-like portions press the terminal fitting at a plurality of positions to maintain a stable position and posture of the terminal fitting.

The plate-like portions preferably are coupled by at least one coupling portion. Thus, the plate-like portions are difficult to deform, and the reliability of a pressing function by the plate-like portions is high.

A recess preferably is formed at a side surface of the multi-functional portion facing the opening edge of the escaping portion. The recess is defined by lateral edges of the plate-like portions and the coupling by arranging the coupling inwardly of lateral edges of the plate-like portions. A lock is formed at the opening edge of the escaping portion and can be accommodated in the recess to prevent a relative displacement of the link.

The multi-functional portion and the lock reliably prevent relative displacement of the link. Further, the lock enters the opening area of the escaping portion, the multi-functional portion may become smaller by as much as an entering part of the lock and an area of the escaping portion closed by the multi-functional portion may become narrower, thereby reducing a function of preventing the entrance of external matters. However, in the present invention, the recess is formed at the side surface of the multi-functional portion and the lock is accommodated in the recess. Thus, the multi-functional portion can be made sufficiently large to cover the opening area of the escaping portion in a wide area.

The multi-functional portion preferably is formed on the first lid. A plate-shaped protection may project from the first lid and may be between an extension of an axis line of the post and the link when the first lid is assembled with the first accommodating portion and the post connecting portion is attached to the post. The multi-functional portion and the protection are coupled by at least one reinforcement.

The protecting portion is between the virtual extension of the axis line of the post and the link when the first lid is assembled with the first accommodating portion and the post connecting portion is attached to the post. Thus, there is no likelihood that a jig used to connect the post connecting portion to the post comes into contact with the link jig. Although the protecting portion is plate-like, the protecting portion is free from deformation since being coupled to the multi-functional portion via the reinforcing portion.

One or more first hinges are located above the protecting portion when the protecting portion is at the protecting position and allow the protecting portion to displace. Thus, the protecting portion can pass a space above the second accommodating portion when being displaced from a protecting position to a retracted position.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 4:
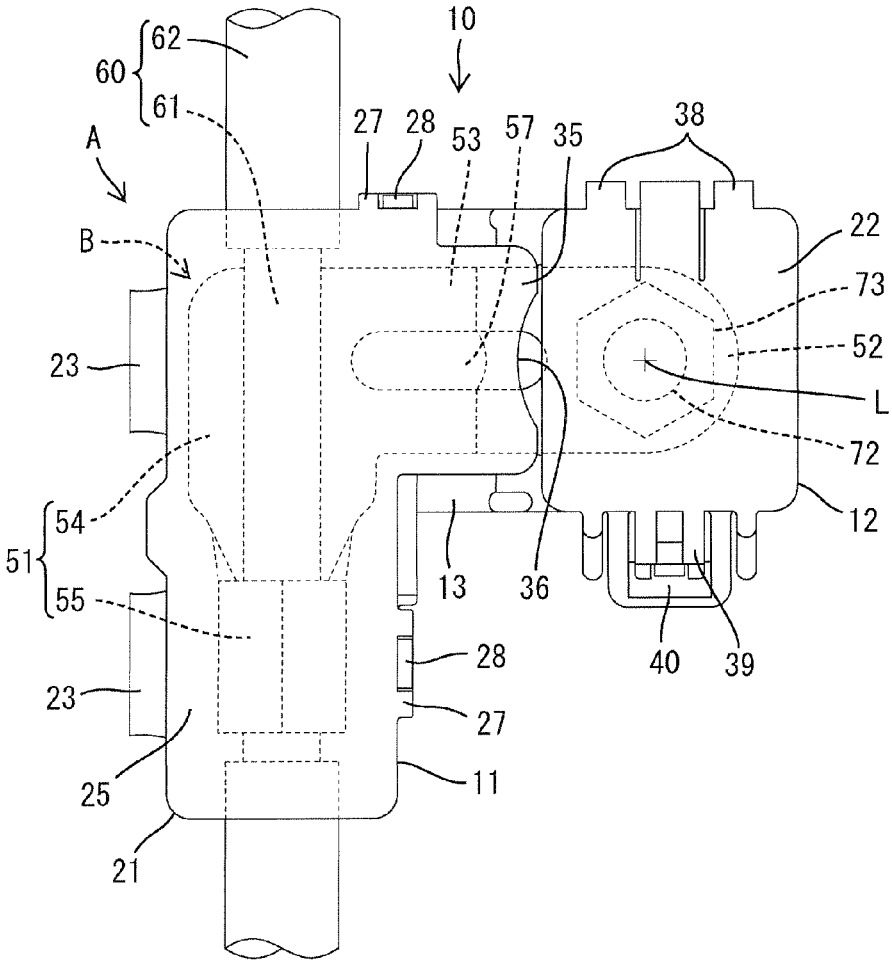
FIG. 4 is a plan view of the terminal fitting accommodated in the terminal cover.
Figure 5:
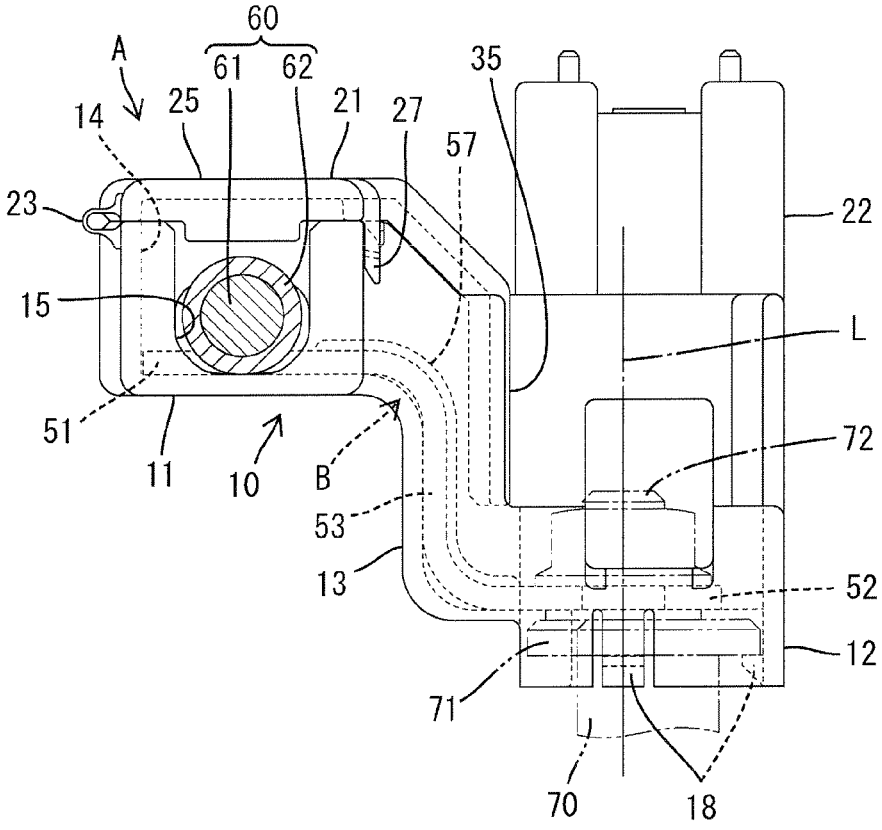
FIG. 5 is a front view showing the terminal fitting is partly assembled with the terminal cover and the terminal fitting is connected to the post.
Figure 6:
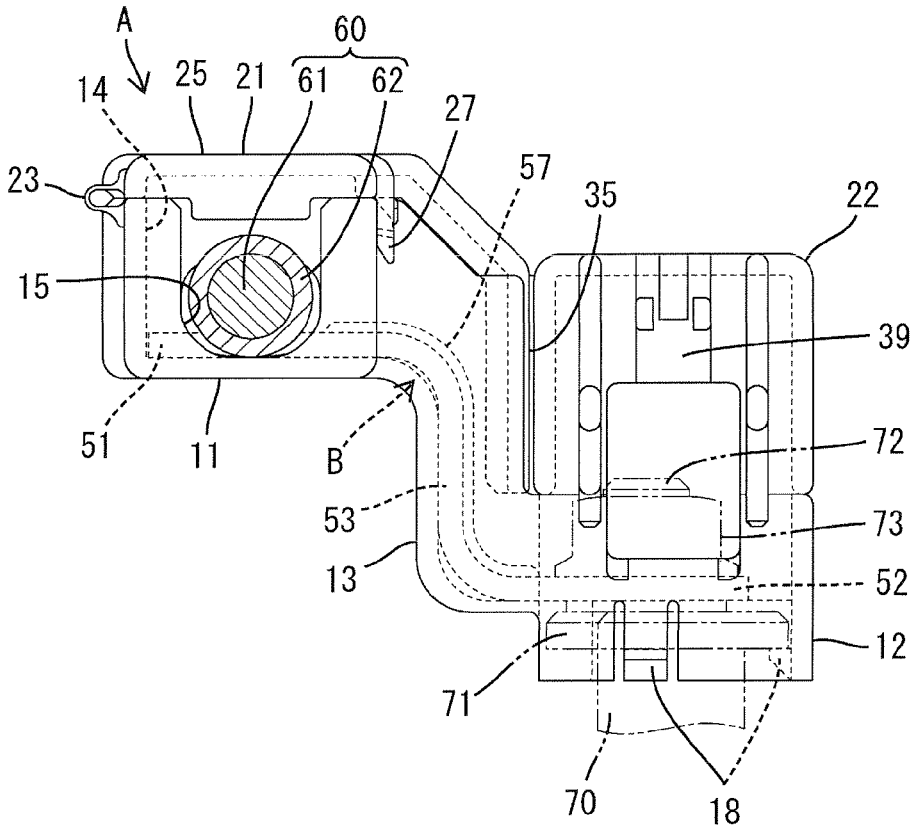
FIG. 6 is a front view showing a state where the terminal fitting is accommodated in the terminal cover and the terminal fitting is connected to the post.

A terminal cover in accordance with the invention is identified by the letter A in FIGS. 1 to 18. The terminal cover A is for at least partly surrounding or covering a terminal fitting B to be attached to a device C (e.g. stator, battery or the like). As shown in FIGS. 5 and 6, a flange 71 is formed on the outer periphery of an upper end of a terminal connecting portion 70 of the device C. A substantially cylindrical post 72 projects on the upper surface of the terminal connecting portion 70 and has an axis line that extends substantially vertically.

Figure 16:
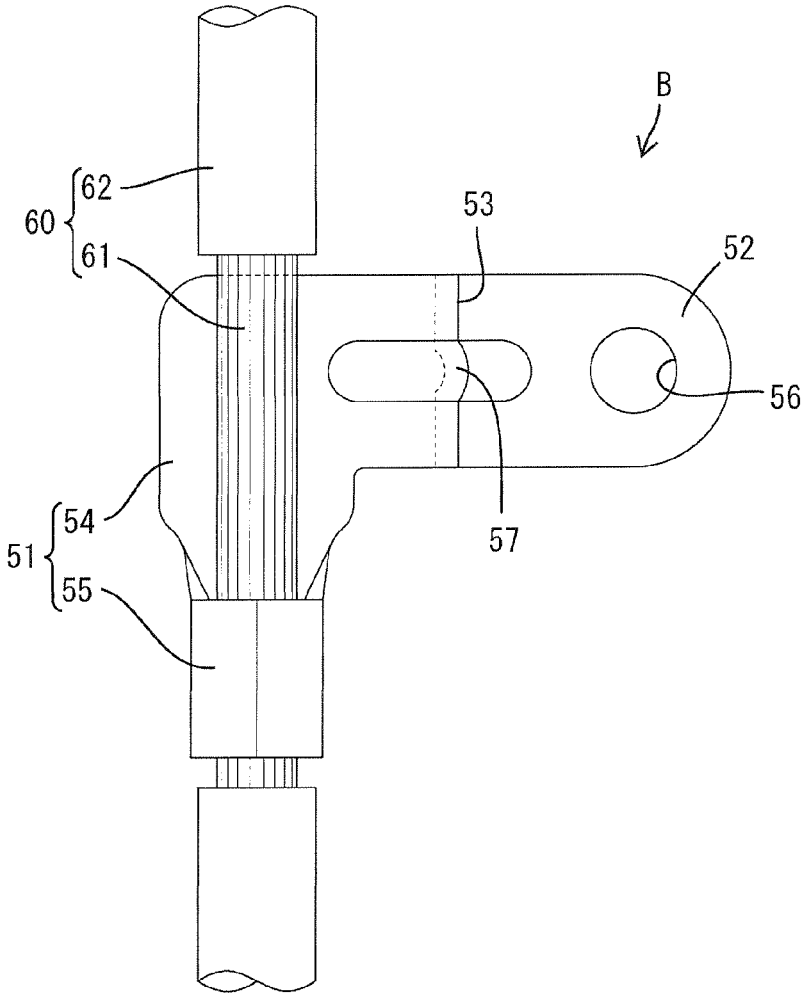
FIG. 16 is a plan view showing a wire connected to the terminal fitting.
Figure 17:
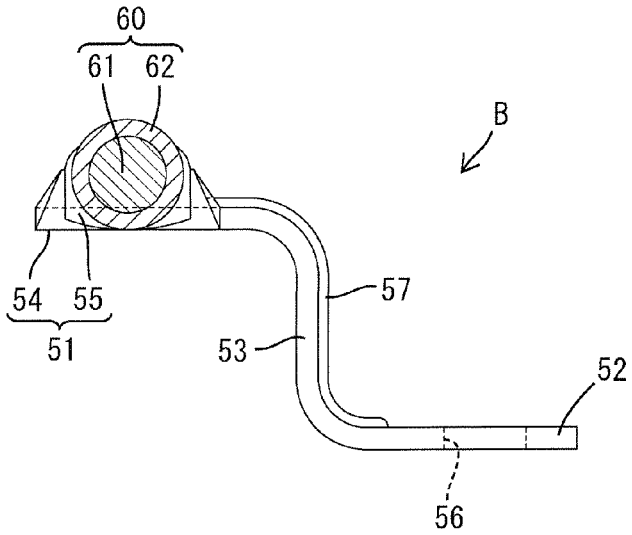
FIG. 17 is a front view showing the wire connected to the terminal fitting.
Figure 18:
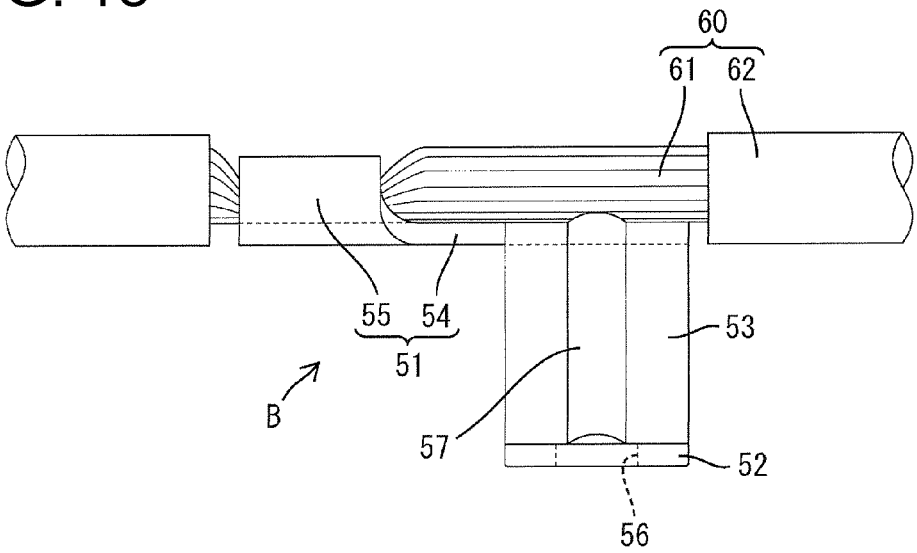
FIG. 18 is a right side view showing the wire connected to the terminal fitting.

As shown in FIGS. 16 to 18, the terminal fitting B is formed by applying a bending, folding and/or embossing process to a conductive metal plate punched out or cut into a specified shape. The terminal fitting B includes a wire connecting portion 51 to be connected to a wire 60, a post connecting portion 52 to be connected to the post 72 and a link 53 linking the wire connecting portion 51 and the post connecting portion 52.

The wire connecting portion 51 has a substantially rectangular base plate 54 and an open barrel-shaped crimping portion 55 is formed near a front end of the base plate 54 (lower end portion in FIG. 16). An intermediate part of the wire 60 is connected electrically conductively to the crimping portion 55. More particularly, an insulation coating 62 is removed from an intermediate part of the wire 60 to expose a conductive core 61 and the crimping portion 55 of the wire connecting portion 51 is crimped, bent or folded into connection with the exposed part of the core 61 so that the exposed core 61 extends substantially along the upper surface of the base plate 54. Accordingly, the terminal fitting B is an intermediate terminal to be connected to the part of the wire 60 other than end portions. The post connecting portion 52 is a substantially horizontal plate and a substantially circular connection hole 56 penetrates the post connecting portion 52 in the vertical direction. This connection hole 56 is mountable to the post 72.

The link 53 is a plate that stands up from a lateral edge of the post connecting portion 52 and is connected to a lateral edge of the base plate 54 of the wire connecting portion 51. The link 53 is aligned substantially parallel to the axial line of the post 72 when the connection hole 56 is fit correctly to the post 72 and is substantially parallel to a penetrating direction of the connection hole 56. Thus, the post connecting portion 52 is at a position lower than the wire connecting portion 51. A lower end of the link 53 has a substantially quarter circular arc shape and is connected smoothly to the post connecting portion 52. An upper end of the link 53 also has a substantially quarter circular arc shape and is connected smoothly to the base plate 54 of the wire connecting portion 51.

The link 53 is hammered or embossed to form a rib 57 as a reinforcing means for suppressing deformation of the link 53. The rib 57 is long and narrow, and extends continuously from the upper end to the lower end of the link 53. The upper end of the rib 57 extends to the base plate 54 and the lower end of the rib 57 extends to the post connecting portion 52. The rib 57 projects convexly toward the post connecting portion 52 along the vertical part of the link 53.

Figure 13:
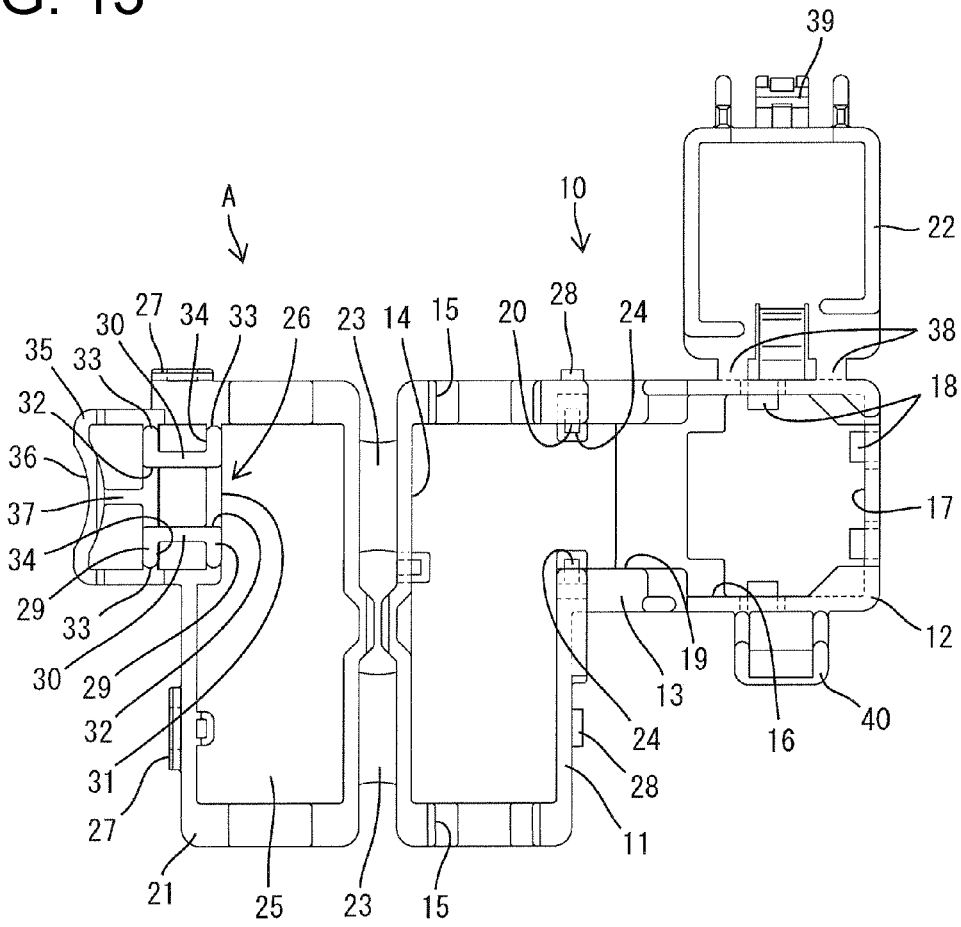
FIG. 13 is a plan view showing a state where the first lid and a second lid are at opening positions in the terminal cover.
Figure 14:
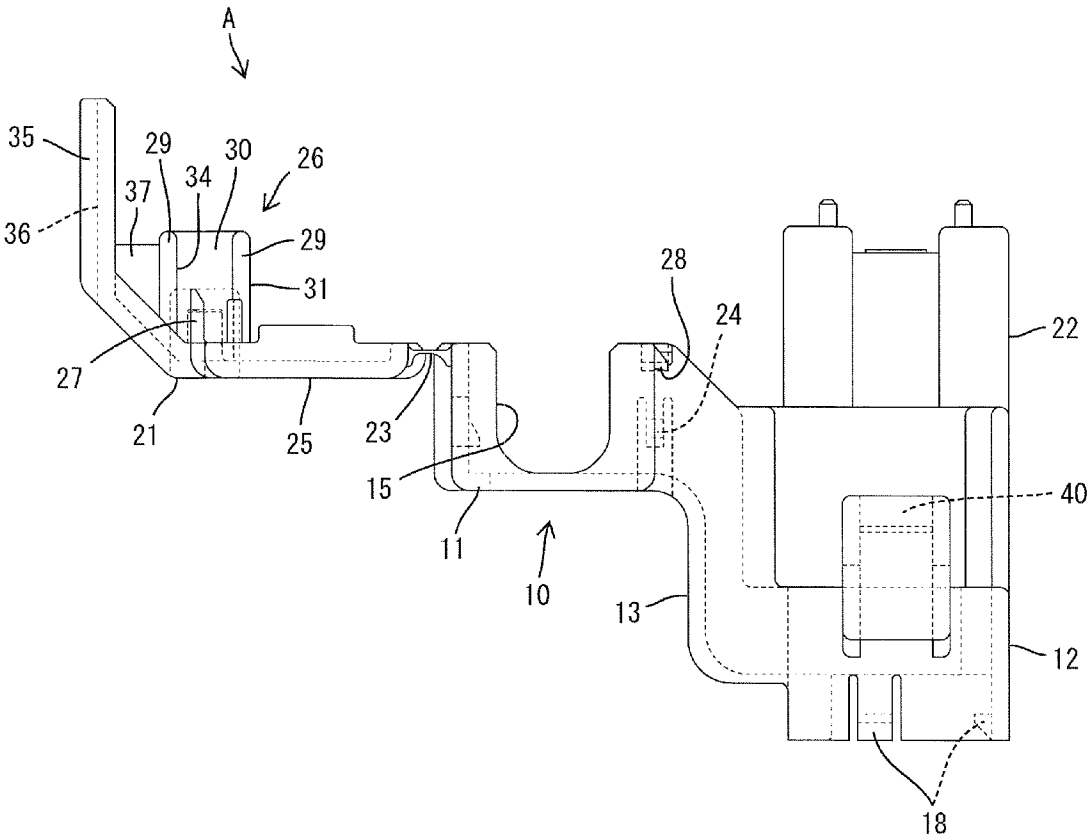
FIG. 14 is a front view showing the state where the first lid and the second lid are at the opening positions in the terminal cover.
Figure 15:
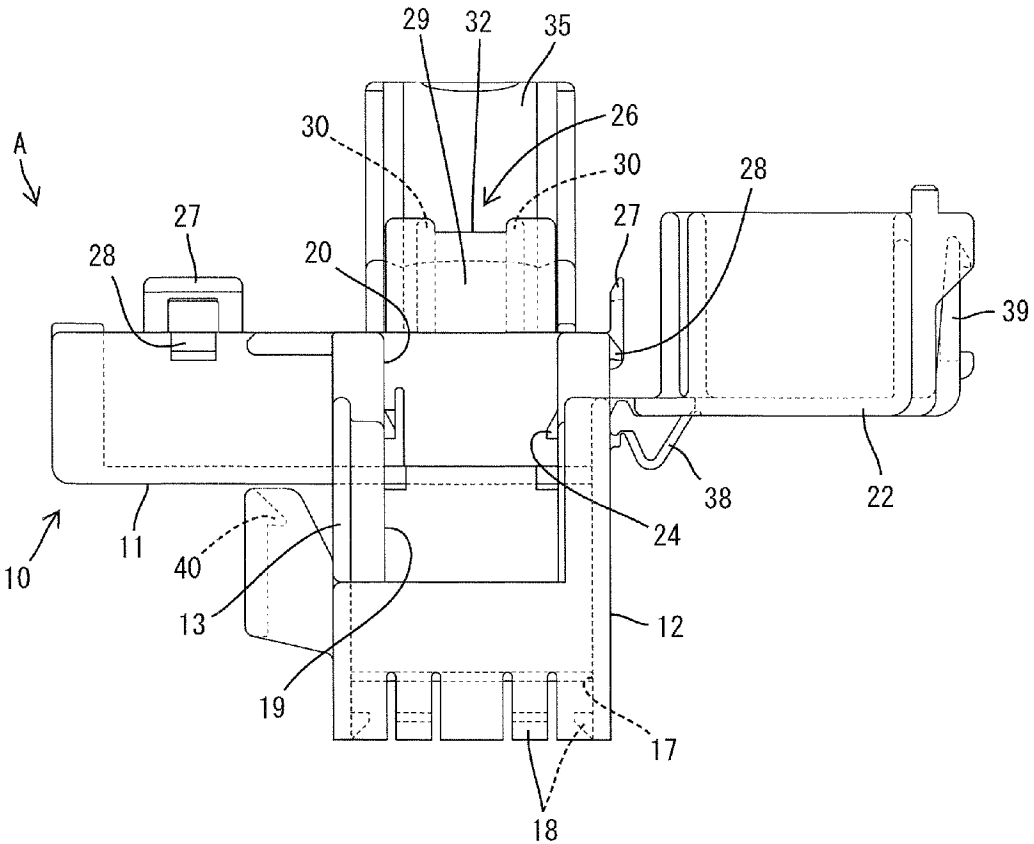
FIG. 15 is a right side view showing the state where the first lid and the second lid are at opening positions in the terminal cover.

The terminal cover A is made e.g. of synthetic resin and is formed as a single part as shown in FIGS. 13 to 15. The terminal cover A includes a main portion 10, a first lid 21 that is displaceable relative to the main portion 10, and a second lid 22 that is displaceable relative to the main portion 10 independently of the first lid 21.

The main portion 10 includes a first accommodating portion 11 for accommodating the wire connecting portion 51, a second accommodating portion 12 for accommodating the post connecting portion 52 and a third accommodating portion 13 for accommodating the link 53. The first accommodating portion 11 defines a rectangular shape that is long in forward and backward directions (vertical direction in FIG. 13) in plan, and the top of the first accommodating portion 11 defines a first opening 14 that is open in the entire area first accommodating portion 11 to insert and pull the wire connecting portion 51 into and out of the first accommodating portion 11. As shown in FIGS. 1, 5, 6, 11 and 12, parts of the front and rear peripheral walls of the first accommodating portion 11 are cut off to form wire lead-out portions 15 to avoid interference with the wire 60.

Figure 1:
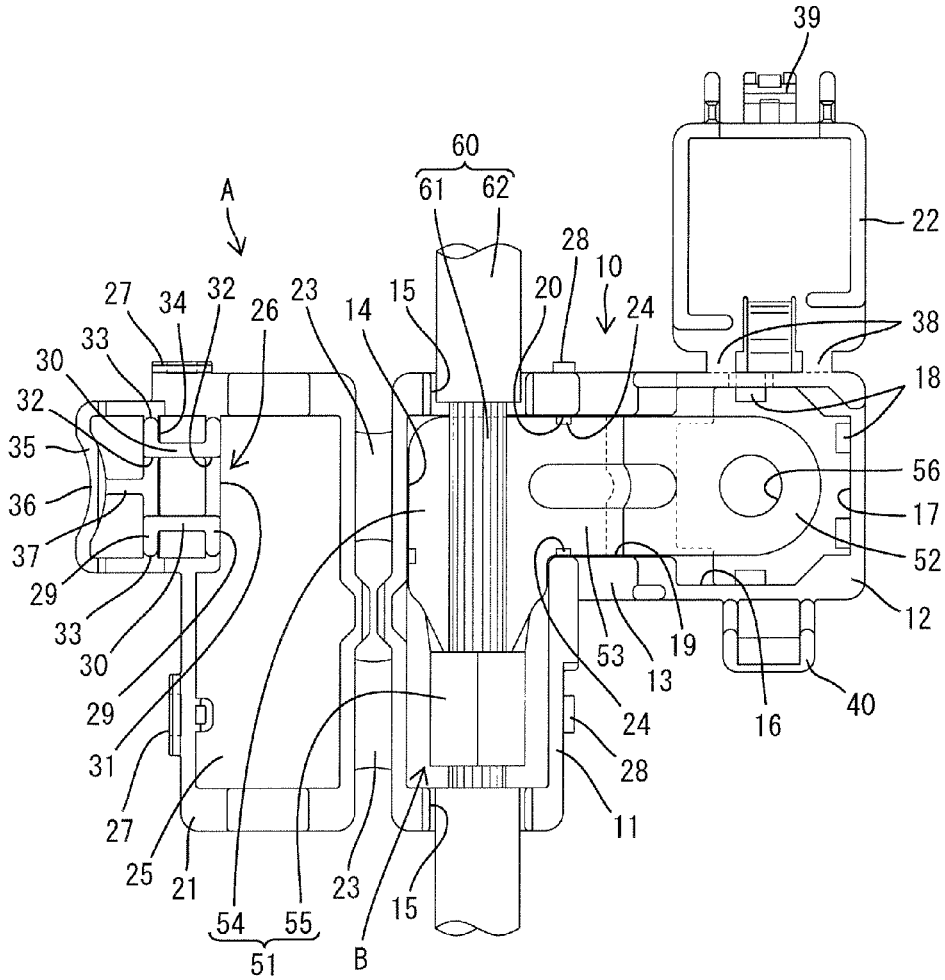
FIG. 1 is a plan view showing a state where a terminal fitting is partly assembled with a terminal cover in one embodiment.

As shown in FIGS. 1 and 13, the second accommodating portion 12 has a substantially square shape in plan view and the top of the second accommodating portion 12 defines a second opening 16 that extends across the entire top of the second accommodating portion 12. The second opening 16 is used to insert and pull the post connecting portion 52 into and out of the second accommodating portion 12. A communication hole 17 is formed in the lower surface of the second accommodating portion 12 and accommodates the flange 71 and the post 72 of the terminal connecting portion 70 of the device C into the second accommodating portion 12. Resilient locks 18 are formed on the opening edge of the communication hole 17 to engage the flange 71.

As shown in FIG. 15, the third accommodating portion 13 has a substantially rectangular shape in side view. An upper end portion of the third accommodating portion 13 communicates with a lateral edge of a rear end of the first accommodating portion 11 and a lower end thereof communicates with a lateral edge of the second accommodating portion 12. The third accommodating portion 13 includes a third opening 19 to insert and pull the link 53 into and out of the third accommodating portion 13. The third opening 19 is open at upper and lateral sides. An upper end of the third opening 19 communicates with an opening area of the first opening 14 and a lower end of the third opening 19 communicates with an opening area of the second opening 16.

As shown in FIGS. 1, 9, 13 and 15, a part of the peripheral wall that forms the first accommodating portion 11 is cut off to form an escaping portion 20 at a communicating part of the first and third accommodating portions 11, 13. The escaping portion 20 is open up and communicates with the first and third openings 14, 19. The internal spaces of the first and third accommodating portion 11 and 13 communicate via the escaping portion 20. In other words, the escaping portion 20 is formed to allow the internal space of the first accommodating portion 11 to communicate with the second accommodating portion 12 via the third accommodating portion 13. The escaping portion 20 ensures that the upper ends of the link 53 and the peripheral wall forming the first accommodating portion 11 will avoid interference and the linking 53 can be accommodated into the third accommodating portion 13 as shown in FIG. 1 when the wire connecting portion 51 is accommodated into the first accommodating portion 11.

As shown in FIGS. 1, 9, 10, 13 and 15, two resiliently deformable locks 24 are formed on the opposite front and rear inner surfaces of the opening edge of the escaping portion 20. The locks 24 are to be engaged with the lateral edges of the link 53 to prevent the link 53 from being displaced up relative to the main portion 10 in a state where the link 53 is accommodated in the third accommodating portion 13. The lower ends of the locks 24 engaged with the link 53 project into an opening area of the escaping portion 20.

As shown in FIGS. 13 and 14, the first lid 21 is coupled to the first accommodating portion 11 via first hinges 23 and is pivotable about the first hinges 23 between a closing position (see FIGS. 2 to 10) for closing the first opening 14 and an opening position (see FIGS. 1, 11, 13 to 15) for opening the first opening 14. The first lid 21 includes a substantially plate-like closing portion 25 to be aligned substantially with the first opening 14 to cover the first opening 14, a multi-functional portion 26 unitary with the closing portion 25 and a protecting portion 35 unitary to the plate-like closing portion 25.

The first hinges 23, as a center of swinging movement of the first lid 21, are connected to front and rear ends of a lateral edge of the opening edge of the first opening 14 substantially opposite to the third opening 19 and the escaping portion 20 and are connected to front and rear ends of a lateral edge of the plate-like closing portion 25. A swing axis of the first lid 21 by the first hinges 23 extends in substantially forward and backward directions. The open first lid 21 is retracted at a side of the first accommodating portion 11 opposite to the second and third accommodating portions 12, 13. Further, resiliently deformable locks 27 are formed near a peripheral edge of the plate-like closing portion 25, and lock projections 28 are formed on the outer surface of the first accommodating portion 11. The locks 27 and the lock projections 28 engage when the first lid 21 is displaced to the closing position to hold the first lid 21 in a locked state and to prevent a displacement of the first lid 21 toward the opening position.

The multi-functional portion 26 is at the rear end of the plate-like closing portion 25 and moves with the first lid 21 to a position corresponding to the escaping portion 20 when the first lid 21 is swung from the opening position to the closing position. The multi-functional portion 26 projects from the inner surface of the plate-like closing portion 25, which is the surface facing into the first accommodating portion 11 when the first lid 21 is at the closing position. The multi-functional portion 26 includes substantially rectangular plates 29 and front and rear couplings 30 all of which project at substantially right angles from the inner surface of the plate-like closing portion 25. The plates 29 are parallel to each other and are spaced apart in a penetrating direction of the link 53 through the escaping portion 20. The front and rear couplings 30 also are substantially parallel to each other and couple the plates 29.

The lateral plates 29 extend in forward and backward directions along substantially the entire opening area of the escaping portion 20. One plate 29 is closer to the first accommodating portion 11 than the peripheral wall that has the escaping portion 20, and the other plate 29 is closer to the third accommodating portion 13 than the peripheral wall that has the escaping portion 20. A receiving surface 31 is defined on the plate 29 at the side of the first accommodating portion 11 extending along the wire 60 in the first accommodating portion 11 and proximately facing the wire 60. The receiving surface 31 can contact the wire 60 to prevent or limit a buckling deformation of the wire 60 caused by an external force on the wire 60.

Figure 9:
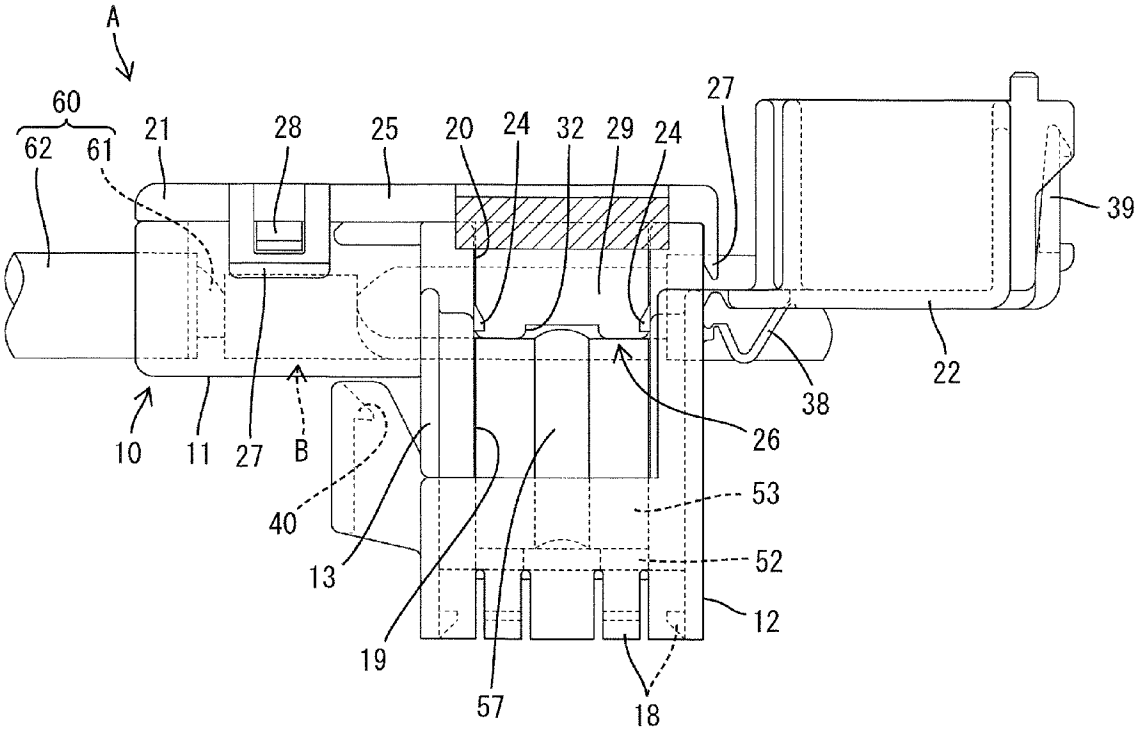
FIG. 9 is a right side view with the first lid in section showing the terminal fitting partly assembled with the terminal cover and the first lid displaced to the close position.
Figure 10:
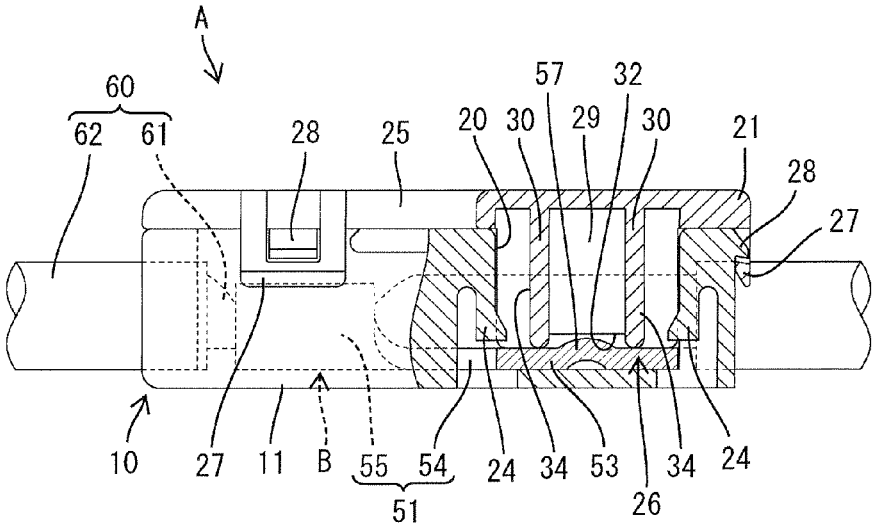
FIG. 10 is a right side view with a multi-functional portion in section showing the terminal fitting partly assembled and with the terminal cover and the first lid at the closed position.
Figure 12:
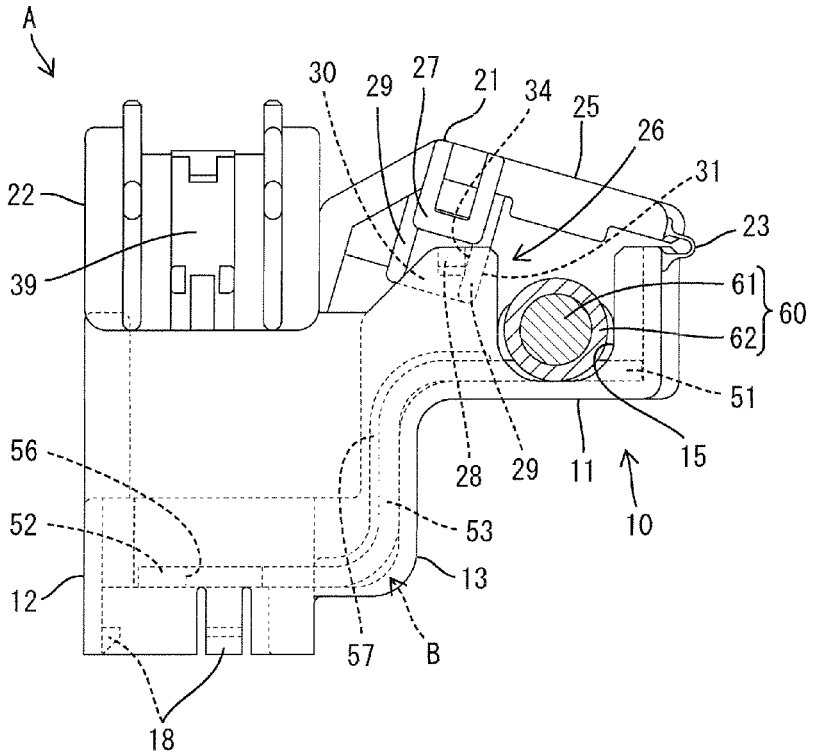
FIG. 12 is a rear view showing the terminal fitting partly assembled with the terminal cover and the first lid on the way from an opening position to the closing position.

As shown in FIGS. 9 and 10, a cutout 32 is formed in each plate 29 to avoid interference with the ribs 57 of the terminal fitting B when the first lid 21 is in the closing position. Further, as shown in FIGS. 1 and 13, curved front and rear guides 33 are formed on end surfaces of the both plates 29. The guides 33 slide in contact with the front and rear inner surfaces of the escaping portion 20 in the process of swinging the first lid 21 from the opening position to the closing position as shown in FIG. 12, thereby preventing the first lid 21 from being displaced relative to the main portion 10 in forward and backward directions and displacing the first lid 21 along a proper assembling path with the first accommodating portion 11. The guides 33 ensure that the locks 27 of the first lid 21 reliably engage the locks 28 of the main portion 10 when the first lid 21 is displaced to the closing position.

As shown in FIGS. 1, 10 and 13, the front coupling 30 is slightly behind the front ends of the plates 29 and the rear coupling 30 is slightly before the rear ends of the plates 29. Thus, the front and rear surfaces of the multi-functional portion 26 are formed respectively with recesses 34 defined by the front and rear ends of the plates 29 and the couplings 30. As shown in FIG. 10, the locks 24 are to be accommodated in the recesses 34 with the first lid 21 displaced to the closing position.

The protecting portion 35 is pivoted from a retracted position (see FIGS. 1, 11, 13 to 15) to a protecting position (see FIGS. 2 to 8) together with the first lid 21 as the first lid 21 is pivoted from the opening position to the closing position. As shown in FIGS. 13 to 15, the protecting portion 35 is a curved plate that is cantilevered from a position of the plate-like closing portion 25 near the multi-functional portion 26. The protecting portion 35 extends toward a side opposite the plate 29 at the side of the first accommodating portion 11 from a position near the plate 29 at the side of the third accommodating portion 13.

The third opening 19 is opened when the protecting portion 35 is at the retracted position so that the link 53 can be inserted into and pulled out of the third accommodating portion 13. Further, while being located at the protecting position, the protecting portion 35 at least partly closes the third opening 19 and is arranged between an extension L of the axis line of the post 72 in the state where the connection hole 56 is fit to the post 72 and the link 53 is in the third accommodating portion 13.

The protecting portion 35 is formed with at least one guiding surface 36 by indenting a surface at the side of the second accommodating portion 12 in the state where the protecting portion 35 is at the protecting position. This guiding surface 36 extends substantially in parallel to the extension L of the axis line of the post 72 when the connection hole 56 is fit to the post 72 and faces the extension L of the axis line of the post 72. Further, the protecting portion 35 is plate-like in its entirety including an area where the guiding surface 36 is formed. In other words, the area of the protecting portion 35 where the guiding surface 36 is a curved plate and the area thereof other than the guiding surface 36 is a substantially flat plate.

Further, a substantially plate-like reinforcement 37 couples the protecting portion 35 and the plate 29 at the side of the third accommodating portion 13. The reinforcement 37 is at central positions of the plate 29 and the protecting portion 35 in forward and backward directions. The first lid 21 is located to correspond to the wire connecting portion 51, whereas the protecting portion 35 is located to correspond to the link 53. Thus, the protecting portion 35 cantilevers from the first lid 21 and conceivable could deform. However, the reinforcement 37 prevents deformation of the protecting portion 35.

As shown in FIGS. 13 and 15, the second lid 22 is coupled to the second accommodating portion 12 via second hinges 38 and can pivot about the second hinges 38 between a closing position (see FIGS. 4, 6 and 8) for closing the second opening 16 and an open position (see FIGS. 1 to 3, 5, 7, 9, 10 to 15) for opening the second opening 16. The second lid 22 is a substantially rectangular box with an open lower side facing the second opening 16 when at the closing position. At least one resiliently deformable lock arm 39 is formed on an outer edge of the second lid 22 substantially opposite the second hinges 38, and at least one lock claw 40 is formed on the outer surface of the second accommodating portion 12. The lock arm 39 and the lock claw 40 engage to lock the second lid 22 at the closing position.

The second hinges 38 are connected to the upper edge of a peripheral wall forming the second accommodating portion 12 and project up above the opening plane of the second opening 16 at such a height as to at least partly overlap the first accommodating portion 11. A swing axis of the second lid 22 by the second hinges 38 extends in the lateral direction (i.e. substantially orthogonal to the swing axis of the first lid 21). The second lid 22 is retracted behind the second accommodating portion 12 when at the open position. However, the second lid 22 overlaps the first accommodating portion 11, the escaping portion 20 and the third accommodating portion 13 in the vertical direction when at the closing position.

The first hinges 23 define a center of swinging movement of the protecting portion 35 and are above the protecting portion 35 when the protecting portion 35 is at the protecting position. The protecting portion 35 passes a space above the second accommodating portion 12 (second opening 16) when being swung from the protecting position to the retracted position. This space above the second accommodating portion 12 is an accommodation space for the second lid 22 when the second lid 22 is displaced to the closing position. Accordingly, the second lid 22 is located near the protecting portion 35 and on the swing path of the protecting portion 35 when the protecting portion 35 is at the protecting position and the second lid 22 is displaced to the closing position to cover the post connecting portion 52, as shown in FIGS. 4 and 6.

Figure 11:
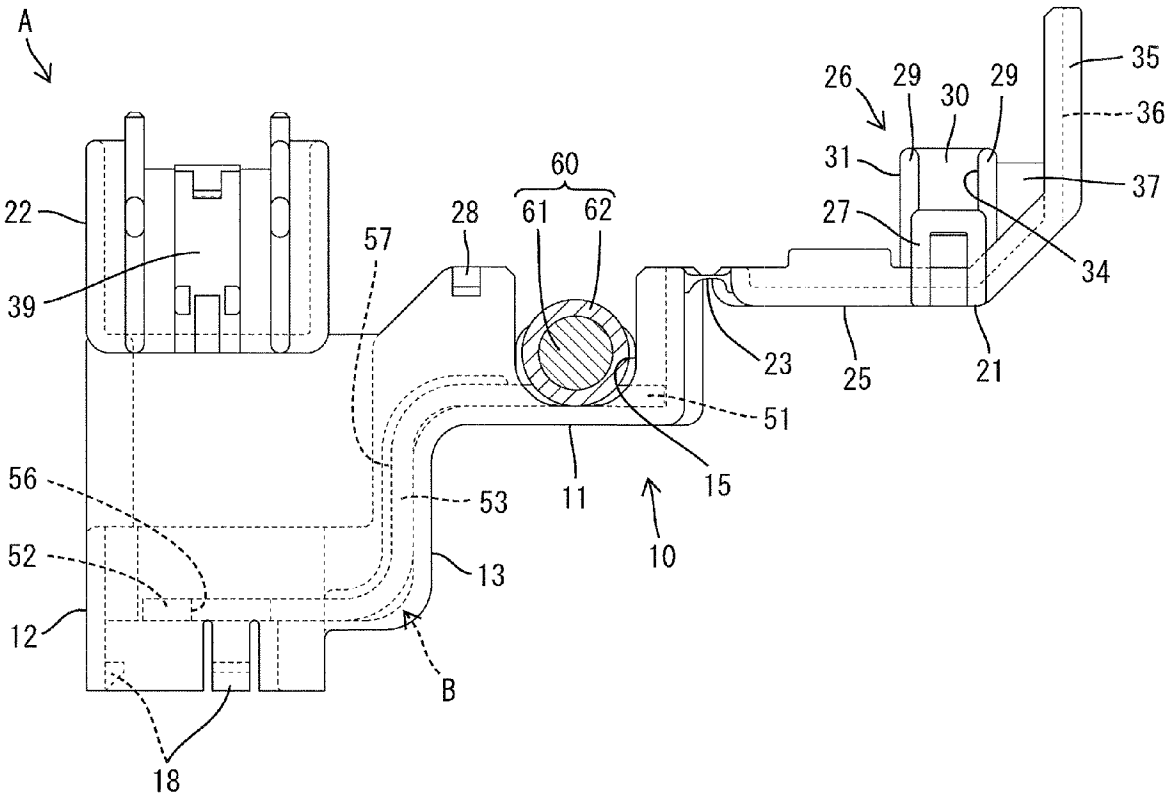
FIG. 11 is a rear view showing the terminal fitting partly assembled with the terminal cover.

Next, functions of this embodiment are described. Initially, the wire 60 is connected to the terminal fitting B and the first and second lids 21, 22 of the terminal cover A are swung to the open positions. In this state, the terminal fitting B is accommodated into the main portion 10 of the terminal cover A so that the wire connecting portion 51 is accommodated in the first accommodating portion 11, the post connecting portion 52 is accommodated in the second accommodating portion 12 and the link 53 is accommodated in the third accommodating portion 13, as shown in FIGS. 1 and 11. When the terminal fitting B is at least partly accommodated into the main portion 10, the locks 24 engage the link 53 to hold the terminal fitting B temporally in a state where an upward displacement of the terminal fitting B relative to the main portion 10 is prevented. Further, the wire 60 is drawn out to the outside of the main portion 10 through the wire lead-out portion 15 and the connection hole 56 of the post connecting portion 52 is located in an opening area of the communication hole 17.

Figure 2:
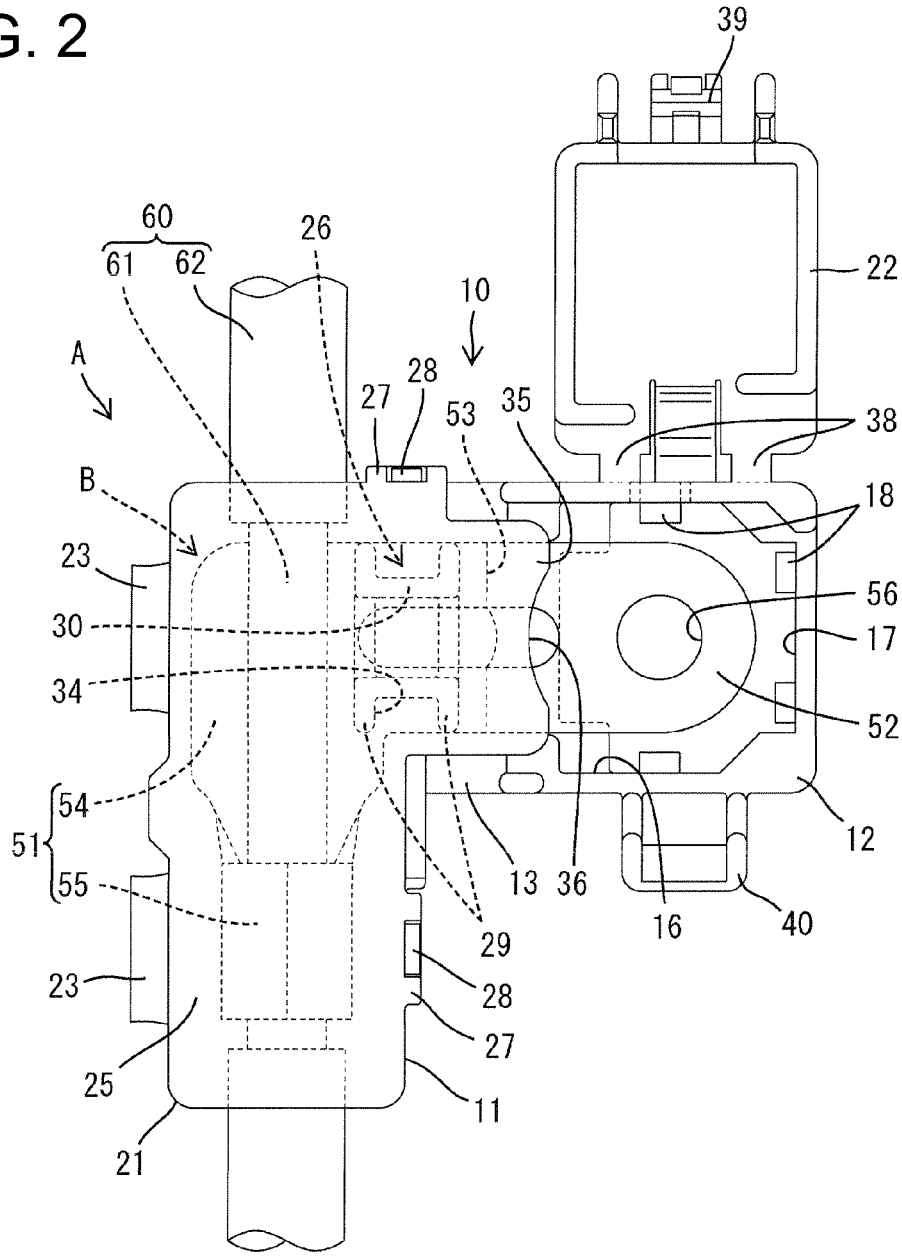
FIG. 2 is a plan view showing a state where the terminal fitting is partly assembled with the terminal cover and a first lid is displaced to a closing position.
Figure 3:
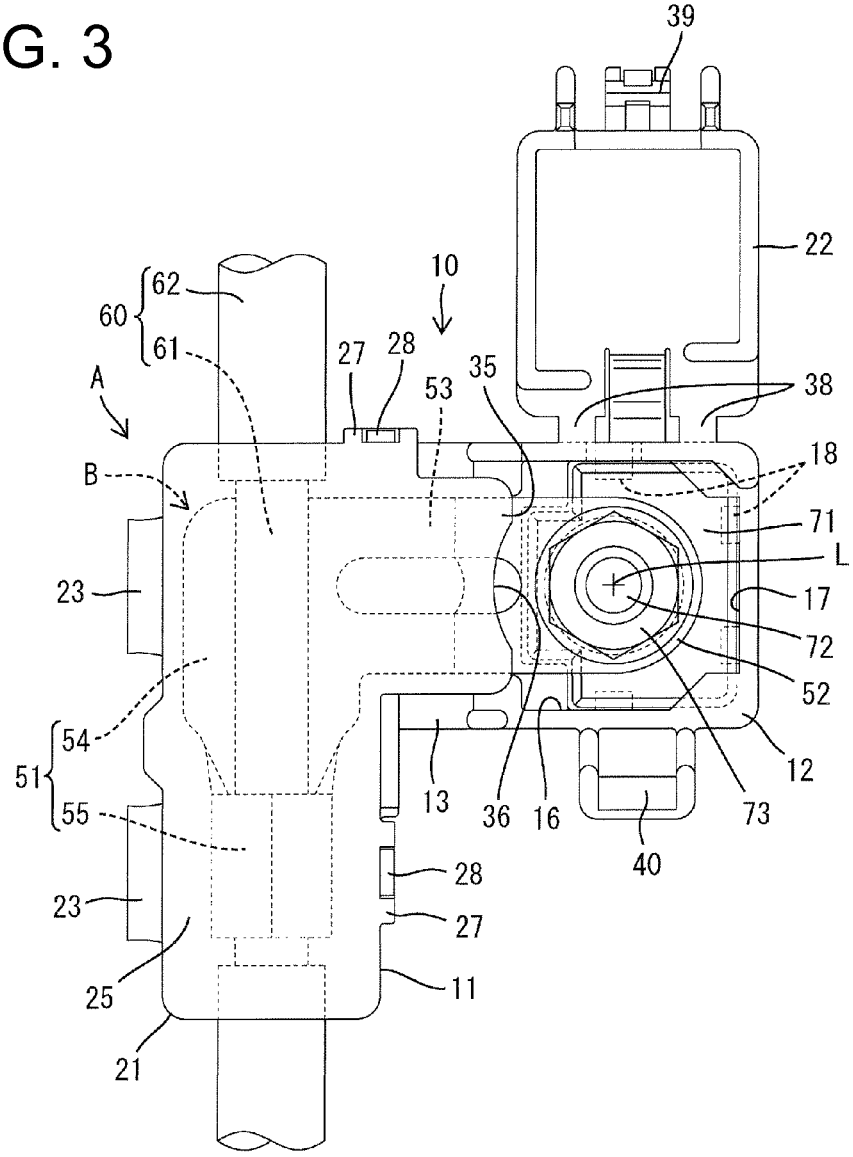
FIG. 3 is a plan view showing a state where the terminal fitting is partly assembled with the terminal cover and the terminal fitting is connected to a post.
Figure 7:
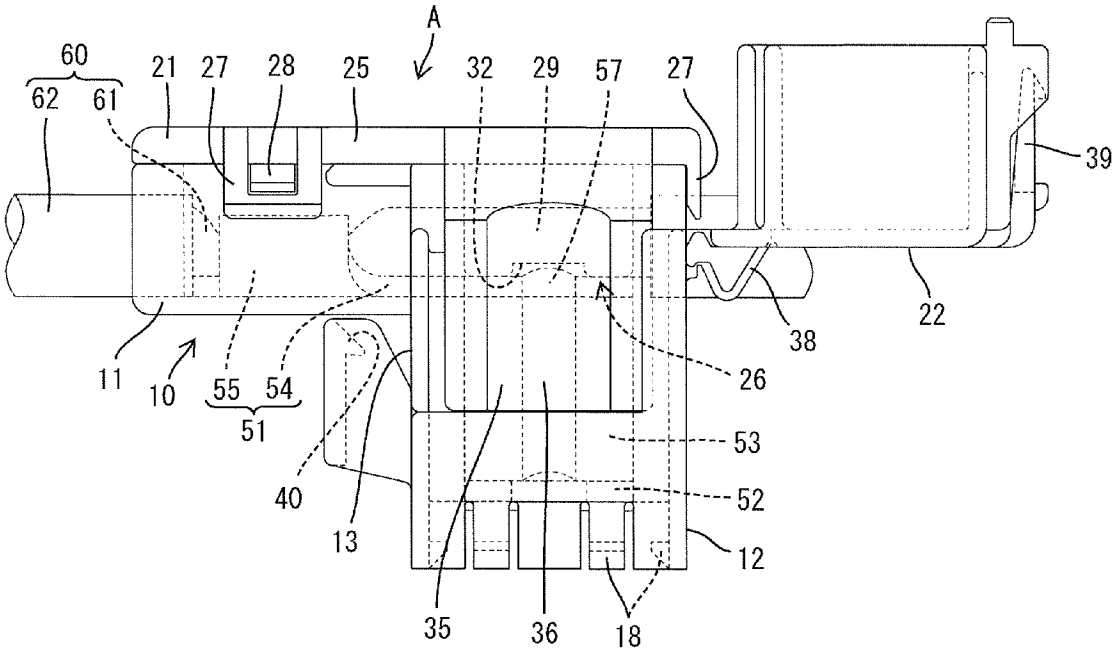
FIG. 7 is a right side view showing the state where the terminal fitting is partly assembled with the terminal cover and the first lid is displaced to the closing position.

Subsequently, the first lid 21 is displaced from the open position to the closed position, as shown in FIGS. 2, 7 and 9. Thus, the wire connecting portion 51 in the first accommodating portion 11 and the link 53 in the third accommodating portion 13 are covered and only the post connecting portion 52 of the terminal fitting B in the second accommodating portion 12 is exposed. The multi-functional portion 26 closes substantially the entire opening area of the escaping portion 20 when the first lid 21 is displaced to the closed position and prevents external matter from entering the first accommodating portion 11 through the escaping portion 20. The multi-functional portion 26 is unitary with the first lid 21 so that the first lid 21 and the multi-functional portion 26 can be assembled with the first accommodating portion by one operation.

The multi-functional portion 26 presses lateral edges of the rear end of the base plate 54 and the upper end of the link 53 from above to prevent an upward displacement of the terminal fitting B relative to the main portion 10. At this time, as shown in FIG. 2, the one plate 29 aligns with the base plate 54 and the other plate 29 aligns with the link 53. Thus, the two plates 29 of the multi-functional portion 26 press the terminal fitting B at two positions to provide a stable position and posture of the terminal fitting B. Further, the couplings 30 couple the plates and make the plates 29 difficult to deform. Thus, the reliability of a pressing function by the multi-functional portion 26 is excellent.

The multi-functional portion 26 has the cutouts 32 and the rib 57 of the terminal fitting B is accommodated in the cutouts 32 as shown in FIG. 9, to prevent displacement of the terminal fitting B relative to the main portion 10 in forward and backward directions (directions crossing a direction in which the multi-functional portion 26 presses the terminal fitting B). This prevents the succeeding operation from being affected due to the displacement of the terminal fitting B.

As described above, the locks 24 help to prevent displacement of the link 53 relative to the main portion 10. The locks 24 enter the opening area of the escaping portion 20. The multi-functional portion 26 may become smaller by as much as entering parts of the locks 24 and an area of the escaping portion 20 closed by the multi-functional portion 26 may become narrower, thereby reducing a function of preventing the entry of external matter. However, the recesses 34 are formed at the side surfaces of the multi-functional portion 26 and the locks 24 are to be accommodated in the recesses 34, as shown in FIG. 10. Thus, the multi-functional portion 26 can be made sufficiently large to cover a wide opening area of the escaping portion 20.

The resilient locking pieces 18 of the terminal cover A engage the flange 71 of the terminal connecting portion 70 of the device C to partly assemble the terminal cover A with the device C after the first lid 21 is displaced to the closing position, as shown in FIGS. 5 and 6. At this time, the post 72 enters the second accommodating portion 12 through the communication hole 17 and is inserted into the connection hole 56. In other words, the connection hole 56 is fit to the post 72.

Thereafter, a jig (not shown) may be used to fasten a nut 73 threadedly to the post 72 to sandwich the post connecting portion 52 fixedly between the nut 73 and the upper surface of the terminal connecting portion 70, as shown in FIGS. 3 to 6. Then, the post 72 and the terminal fitting B are connected electrically conductively and the terminal fitting B and the terminal cover A are fixed to the post 72.

The jig is moved toward and away from the post 72 along the extension L of the axis line of the post 72 while the connection hole 56 is fit to the post 72. This movement path of the jig is in an area directly facing the link 53 and close to the link 53. However, the protecting portion 35 is displaced from the retracted position to the protecting position by displacing the first lid 21 from the open position to the closed position, and is between the link 53 and the extension L of the axis line of the post 72 in the state where the connection hole 56 is fit to the post 72. Therefore, the jig will not damage the link 53.

The protecting portion 35 is not located right above the second opening 16 on the movement path of the jig, but is displaced laterally toward the third accommodating portion 13, as shown in FIG. 5. Thus, the protecting portion 35 does not affect the operation of the jig. Further, the protecting portion 35 is formed with the arcuately indented guiding surface 36 and the jig is guided efficiently to a specified position by sliding in contact with the guiding surface 36 when the jig is brought toward the post 72. The area of the protecting portion 35 with the guiding surface 36 is a curved plate. Thus, space saving is realized without reducing strength, as compared with the case where the protecting portion 35 is a block. The protecting portion 35 is a plate and is coupled to the reinforcement 37 to prevent deformation in response to contact by the jig.

Figure 8:
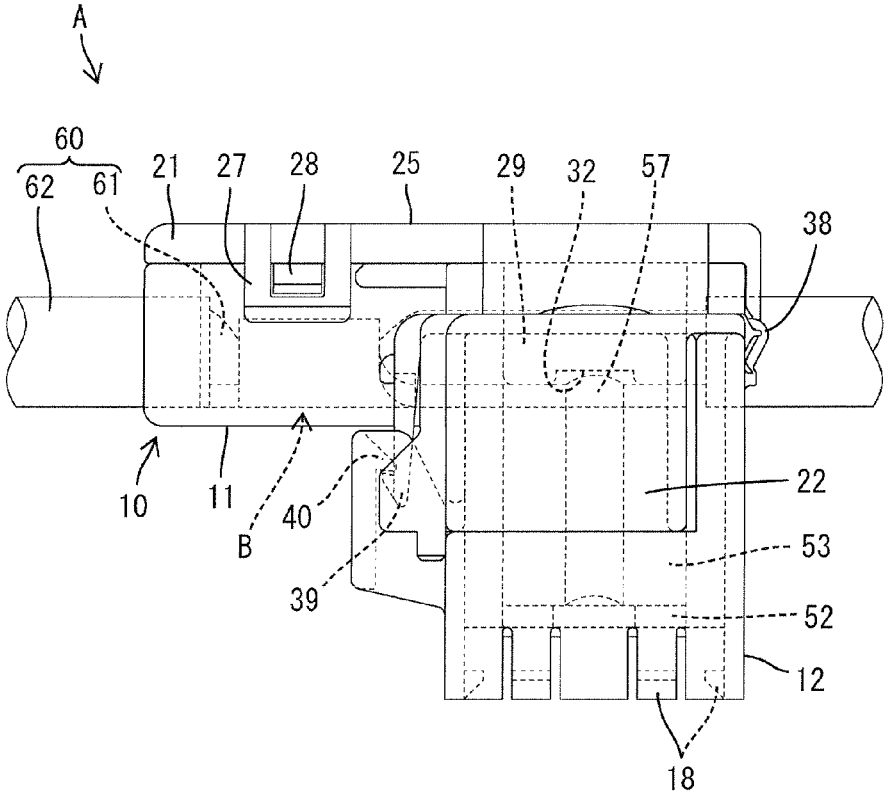
FIG. 8 is a right side view showing the terminal fitting accommodated in the terminal cover.

The second lid 22 is displaced from the open position to the closed position to cover the post connecting portion 52 after the terminal fitting B is connected to the post 72, as shown in FIGS. 4 and 8. Thus, the terminal fitting B is surrounded by the terminal cover A to complete the assembling of the terminal fitting B and the terminal cover A. As described above, the protecting portion 35 is coupled to the main portion 10 and can swing between the retracted position and the protecting position. Additionally, the second lid 22 is located near the protecting portion 35 on the swing path of the protecting portion 35 in a state where the protecting portion 35 is at the protecting position and the post connecting portion 52 is covered by the second lid 22. Accordingly, even if the lock pieces 27 and the lock projections 28 are disengaged to unlock the first lid 21 in this state, the protecting portion 35 contacts the second lid 22, and there is no likelihood of displacing the first lid 21 from the closed position to the open position.

The multi-functional portion 26 is unitary with the first lid 21. Thus, the number of parts is reduced and the first lid 21 and the multi-functional portion 26 can be assembled with the first accommodating portion 11 by one operation as compared with the case where the multi-functional portion 26 is separate from the first lid 21. Further, the protecting portion 35 is coupled unitarily to the main portion 10 via the first hinges 23. Thus, the number of parts can be reduced as compared with the case where the protecting portion 35 is separate from the main portion 10. In addition, since the protecting portion 35 is displaced to the protecting position when the first lid 21 is displaced to the closed position, the first lid 21 and the protecting portion 35 can be displaced by one operation.

The invention is not limited to the above described and illustrated embodiment. For example, the following embodiments are also included in the technical scope of the present invention.

The terminal fitting functions as an intermediate terminal connected to a part of a wire other than end portions in the above embodiment. However, the invention is also applicable when a terminal fitting is connected to an end portion of a wire.

The multi-functional portion closes the entire opening area of the escaping portion in the above embodiment. However, it may close only a part of the opening area of the escaping portion.

The multi-functional portion is integral to the first lid in the above embodiment, but it may be separate from the first lid.

The first lid is coupled to the first accommodating portion via the first hinges in the above embodiment, but it may be a separate part.

The second lid is coupled to the second accommodating portion via the second hinges in the above embodiment, but the second lid may be a separate part.

The receiving surface of the multi-functional portion extends along the wire when the multi-functional portion is assembled with the first accommodating portion in the above embodiment. However, the multi-functional portion may extend in a direction different from the longitudinal direction of the wire at a position distant from the wire.

The link has the rib projecting toward the multi-functional portion in the above embodiment, but the invention is applicable when the link has no rib.

The multi-functional portion is formed with the cutouts for accommodating the rib of the terminal fitting in the above embodiment, but the rib may be pressed by the multi-functional portion without forming the multi-functional portion with such cutouts.

The multi-functional portion has two plate-like portions spaced apart in the penetrating direction of the link through the escaping portion in the above embodiments. However, the multi-functional portion may be a single plate.

Although the multi-functional portion includes two plates in the above embodiment, it may include three or more plates.

Although the multi-functional portion has a plate-like shape in the above embodiment, it may have other shapes.

Two plates are coupled by the couplings in the above embodiment, they may not be coupled by the couplings and may project independently from the first lid.

Recesses are formed at the side surfaces of the multi-functional portion and the locks are accommodated in the recesses in the above embodiment. However, the locks may be exposed outside the multi-functional portion in an assembled state of the multi-functional portion without forming the recesses at the side surfaces of the multi-functional portion.

The first lid has the protecting portion between the extension of the axis line of the post and the link when the first lid is assembled with the first accommodating portion and the post connecting portion is attached to the post in the above embodiment. However, the invention is also applicable when the first lid has no protecting portion.

The part of the wire corresponding to the base plate of the wire connecting portion has the insulation coating removed to expose the core in the above embodiment. However, the insulation coating may surround the core at the part of the wire corresponding to the base plate.

What is claimed is:

1. A terminal cover for surrounding a terminal fitting that has a wire connecting portion to be connected to a wire, a post connecting portion to be connected to a post of a device and a link linking the wire connecting portion and the post connecting portion, the terminal cover comprising:

a first accommodating portion for accommodating the wire connecting portion and including a first opening to receive the wire connecting portion;

a first lid hingedly connected to the first accommodating portion by at least one first hinge so that the first lid is movable into a position to cover the first opening;

a second accommodating portion for accommodating the post connecting portion and including a second opening to receive the post connecting portion;

a second lid hingedly connected to the second accommodating portion by at least one second hinge so that the second lid is movable into a position to cover the second opening;

an escaping portion recessed in a part of a peripheral wall of the first accommodating portion and providing communication between an internal space of the first accommodating portion and the second accommodating portion, thereby avoiding interference with the link, and a multi-functional portion disposed and configured for selectively closing at least a part of an opening area of the escaping portion, pressing the terminal fitting and preventing a displacement of the terminal fitting in an assembled state, the multi-functional portion being configured so that only the post connecting portion of the terminal fitting in the second accommodating portion is exposed to regions exterior of the terminal cover when the first lid is closed.

2. The terminal cover of claim 1, wherein the multi-functional portion is formed on the first lid.

3. The terminal cover of claim 2, wherein the first accommodating portion and the first lid are formed with locks that engage each other to lock the first lid in an assembled state where the first lid closes the first opening.

4. The terminal fitting of claim 2, wherein the multi-functional portion has at least one guide that slides in contact with the opening edge of the escaping portion to guide a displacement of the first lid along a proper assembling path with the first accommodating portion.

5. The terminal cover of claim 2, wherein the multi-functional portion includes a receiving surface arranged to extend substantially along the wire connected to the wire connecting portion when the multi-functional portion is assembled with the first accommodating portion.

6. The terminal cover of claim 2, wherein the multi-functional portion has at least one cutout for accommodating at least one rib on the link.

7. The terminal cover of claim 2, wherein the multi-functional portion includes a plurality of substantially plates spaced apart from each other in a penetrating direction of the link through the escaping portion.

8. The terminal cover of claim 7, wherein the plates are coupled by at least one coupling.

9. The terminal cover of claim 8, wherein the escaping portion is arranged inward of lateral edges of the plates to define a recess at a side surface of the multi-functional portion substantially facing an opening edge of the escaping portion.

10. The terminal cover of claim 9, wherein a lock is formed at the opening edge of the escaping portion, the lock being disposed to be accommodated in the recess and to engage the link and prevent relative displacement of the link.

11. The terminal cover of claim 2, wherein a protecting portion projects from the first lid and is disposed between an extension of an axis line of the post and the link when the first lid is assembled with the first accommodating portion and the post connecting portion is attached to the post.

12. The terminal cover of claim 11, wherein the multi-functional portion and the protecting portion are coupled by at least one reinforcement.

13. The terminal cover of claim 11, wherein the first hinges are located above the protecting portion when the protecting portion is at the protecting position, the first hinges allowing displacement of the protecting portion, whereby the protecting portion can pass a space above the second accommodating portion when being displaced from a protecting position to a retracted position.

14. The terminal cover of claim 1, wherein the multi-functional portion is unitary with the first lid.

* * * * *